US010954632B2

(12) United States Patent
Pihko et al.

(10) Patent No.: US 10,954,632 B2
(45) Date of Patent: Mar. 23, 2021

(54) METHOD AND APPARATUS FOR PRODUCING A FIBRE WEB

(71) Applicant: Teknologian tutkimuskeskus VTT Oy, Espoo (FI)

(72) Inventors: Riku Pihko, Jyväskylä (FI); Jani Lehmonen, Jyväskylä (FI); Kay Rökman, VTT (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 27 days.

(21) Appl. No.: 16/339,476

(22) PCT Filed: Oct. 4, 2017

(86) PCT No.: PCT/FI2017/050696

§ 371 (c)(1),
(2) Date: Apr. 4, 2019

(87) PCT Pub. No.: WO2018/065668

PCT Pub. Date: Apr. 12, 2018

(65) Prior Publication Data

US 2020/0040528 A1 Feb. 6, 2020

(30) Foreign Application Priority Data

Oct. 5, 2016 (FI) ..... 20165747

(51) Int. Cl.
*D21F 1/52* (2006.01)
*D21F 9/00* (2006.01)
(Continued)

(52) U.S. Cl.
CPC ..... *D21F 9/003* (2013.01); *D21F 1/52* (2013.01); *D21F 3/0209* (2013.01); *D21F 5/048* (2013.01); *D21F 11/002* (2013.01)

(58) Field of Classification Search
USPC ..... 162/210
See application file for complete search history.

(56) References Cited

U.S. PATENT DOCUMENTS 4,976,820 A * 12/1990 Laapotti ..... D21F 3/0218 100/332
6,238,518 B1 5/2001 Rokman et al.
(Continued)

FOREIGN PATENT DOCUMENTS

CN 1096551 A 12/1994
CN 101180437 A 5/2008
(Continued)

*Primary Examiner* — Mark Halpern
(74) *Attorney, Agent, or Firm* — Laine IP Oy

(57) ABSTRACT

According to an example aspect of the present invention, there is provided an apparatus and a method comprising a forming section for feeding an aqueous furnish of fibres on a moving surface to form a shape of a product and a pressing and heating section for removing water from the shaped product received from the moving surface. The pressing and heating section comprises a felt and metal belt that are set to run against each other for receiving the furnish from the moving surface and heating elements for heating the web in at least two pulses including at least one first pulse wherein the product is pressed for at least 10-200 ms on a first pressure and at least one second heating and smoothing pulse wherein the product is heated at least for 10-200 ms on a pressure that is higher than the first pressure, and at least one of the surfaces pressing the product being the smooth metal belt.

19 Claims, 10 Drawing Sheets

(51) Int. Cl.

| | |
|---|---|
| ***D21F 3/02*** | (2006.01) |
| ***D21F 5/04*** | (2006.01) |
| ***D21F 11/00*** | (2006.01) |

(56) References Cited

U.S. PATENT DOCUMENTS

| | | | |
|---|---|---|---|
| 6,503,372 | B1 | 1/2003 | Rokman et al. |
| 2010/0187171 | A1 | 7/2010 | Gupta |
| 2010/0187712 | A1 | 7/2010 | Gupta et al. |

FOREIGN PATENT DOCUMENTS

| | | | |
|---|---|---|---|
| CN | 101338530 | A | 1/2009 |
| CN | 102066661 | A | 5/2011 |
| CN | 102159767 | A | 8/2011 |
| CN | 105291500 | A | 2/2016 |
| DE | 102012202535 | A1 | 8/2012 |
| EP | 2063021 | A1 | 5/2009 |
| EP | 2722434 | A1 | 4/2014 |
| EP | 2722437 | A1 | 4/2014 |
| WO | WO2006125856 | A1 | 11/2006 |
| WO | WO2009024186 | A1 | 2/2009 |
| WO | WO2009129842 | A1 | 10/2009 |
| WO | WO2009129843 | A1 | 10/2009 |
| WO | WO2015187831 | A1 | 12/2015 |

* cited by examiner

| Quantity | Foam forming | Metal belt pressing and drying | Foam forming and metal belt pressing and drying | Effect |
|---|---|---|---|---|
| Dryness after press, changes in dryness % | + 1-5 % | + 6-14 % | + 10-20 % | Increased production, lower investment & production costs |
| Bulk after press, relative change | + 10-15 % | + 12-30 % | + 15-45 % With z-foaming up to + 80 % | Raw material savings |
| Smoothness after press, relative change | + 5-30 % | + 35-75 % | + 40-85 % | Improved properties, less need for calandering |

FIG. 10

METHOD AND APPARATUS FOR PRODUCING A FIBRE WEB

This application is a 371 of PCT/FI2017/050696 filed 04 Oct. 2017.

BACKGROUND

The invention concerns method and apparatus for producing elongate fibre products, especially from a furnish comprising cellulosic pulp from plant materials. The products may be webs, yarns, fabrics or similar.

Producing webs or other products from fibres is basics of paper and board manufacture. Most manufacturing methods include making a mix of fibres, water and fillers and additives (furnish) and feeding the furnish on a permeable surface to remove water and form a web of entangled fibres that are held together by chemical bonds and mechanical forces. The furnish may be foamed to provide specific formation characteristics. The web is usually rather wet after formation and further water removal is needed. This can be done mechanically in a pressing nip or by heating by various methods. Different formation and water removal methods are combined in order to obtain desired end products and designing the manufacturing process defines the product range that can be manufactured.

One way to form a web on fabric or similar forming surface is to use feeding funnels. The greatest problem regarding such art (US 2010187712 and US 2010187171) is the great amount of funnels, which are difficult to arrange properly in a production scale. Flow variations occur and bending of structures distorts the feeding process. Processes described in these publications are not applicable in production scale. There is also publications U.S. Pat. No. 6,238,518 (B1) and U.S. Pat. No. 6,503,372. This publication presents how to produce multi-layered webs. The drawback of this method is that there is no method or apparatus describing how to arrange fibres in wished directions in different layers. Fibres are orientated mostly in machine direction and fibre orientation can't be controlled efficiently.

Various methods and processes for water removal are described in publications WO 2009024186, EP 2722437, EP 2063021, EP 2722434.

Known methods for producing webs, fabrics, yarns and such products from fibres have their characteristic strengths and drawbacks. Some methods are suitable for cellulosic material and others better suitable for artificial fibres or mixtures of these fibres. Therefore there is need for novel methods for manufacture of these products.

SUMMARY OF THE INVENTION

The invention is defined by the features of the independent claims. Some specific embodiments are defined in the dependent claims.

According to a first aspect of the present invention, there is provided a method for producing elongate fibre products, wherein a narrowing nip is formed of two moving permeable fabrics. Furnish of at least water and fibres is fed into the nip of the fabrics by a feeding apparatus comprising at least one guide surface that forms a gap together with at least one of the fabrics.

According to a second aspect of the present invention, there is provided an apparatus for producing elongate fibre products comprising two mobile permeable fabrics set to run opposite to each other so that a narrowing gap is formed between the fabrics and a feeding apparatus comprising at least one guide surface that forms a gap together with at least one of the fabrics and at least one opening for feeding furnish formed of at least of water and fibres to the nip formed of the fabrics.

According to a third aspect of the invention, there is provided a fibre product wherein at least 10% of the fibres have at least part of their length in a at least 10 degree angle in view of x-y-plane defining the broadest dimension of the web.

According to a fourth aspect of the invention, there is provided at least one vacuum box at the side of at least one of the fabrics that is opposite to the side facing the narrowing nip and the applicator apparatus.

According to a fifth aspect of the invention there is provided a method producing elongate fibre products wherein furnish of fibres and water is formed to an elongate product and subsequently transferred to a drying step including at least two pulses including at least one heating pulse wherein the product is pressed for at least 10 ms on a first pressure and at least one heating and smoothing pulse wherein the product is heated at least for 10-200 ms on a pressure that is higher than the first pressure, the heating temperature being at least 80° C. on at least one surface of the product and at least one of the surfaces pressing the product being a smooth belt.

According to a sixth aspect of the invention, the temperature of the product entering to the pressing and heating step is gradually increased from incoming temperature of 30-80° C. to a drying temperature of 80-100° C.

According to a seventh aspect of the invention, at least a part of the furnish is fed as first flow to the middle of the nip of the fabrics so that the flow is directed essentially parallel to mobile fabrics to the travel direction of the fabrics.

According to an eight aspect of the invention, at least a part of the furnish is fed on the surface of at least one of the fabrics on first velocity that is lower than the velocity of the fabric.

According to a ninth aspect of the invention, at least a part of the furnish is fed towards at least one of the fabrics in a flow direction that is at least partially perpendicular to the fabric.

According to a tenth aspect of the invention, the furnish is fed on the nip of the fabrics as a mixture of foam and fibres.

According to an eleventh aspect of the invention, the furnish is fed on the nip of the fabrics as one central first flow to form a central layer of the web-like product, as two secondary flows perpendicular to the fabrics on both sides of the central flow to form second layers or the product and as two tertiary flows having speed lower than the fabrics and being fed on both sides of the central flow, the feeding points of the second flows being upstream of the first flow and feeding points of the third flows being upstream to the second flows.

According to a twelfth aspect of the invention, suction is applied on the fabrics at least downstream of the feeding point of the second flow, the second flow being the flow directed at least partially perpendicular to the surface of the mobile fabric.

According to a thirteenth aspect of the invention, there is provided a method and apparatus comprising a forming section for feeding an aqueous furnish of fibres on a moving surface to form a shape of a product and a pressing and heating section for removing water from the shaped product received from the moving surface, wherein the pressing and heating section comprises a felt and metal belt that are set to run against each other for receiving the furnish from the moving surface, and heating elements for heating the web between the felt and the belt in at least two pulses including at least one heating pulse wherein the product is pressed for at least 10 ms on a first pressure and at least one heating and smoothing pulse wherein the product is heated at least for 10-200 ms on a pressure that is higher than the first pressure, the heating temperature being at least 80° C. on at least one surface of the product and at least one of the surfaces pressing the product being the smooth metal belt.

According to a fourteenth aspect of the invention, there is provided an apparatus, wherein the heating elements for heating the web comprise at least one roll against which the felt and the belt are arranged to run and at least one heater for heating the belt.

BRIEF DESCRIPTION OF THE DRAWINGS

FIG. 7-10 illustrate results of comparative test showing products made by some embodiments of the invention and known methods.

EMBODIMENTS

Definitions

In the present context, the term "fibre" comprises cellulosic fibres obtained from plants and artificial fibres.

The invention relates to production of paper and board webs, tissue, yarns, nonwovens and other such products made of cellulosic fibres, or artificial fibres and mixtures thereof. These products are generally made of aqueous furnish of fibres that is spread on a fabric to form a product and subsequently dried by pressure and heat. The purpose of at least some of the embodiments of the invention is to provide new approaches to formation and drying process of the product in order to provide at least some new, improved products and/or changes or improvements to the manufacturing process.

In the following the word web is used to nominate the product to be manufactured. This nomination is used for simplicity only and is to be considered to encompass all elongated fibre products mentioned above and below if another nomination is not specifically used.

Figure 1:
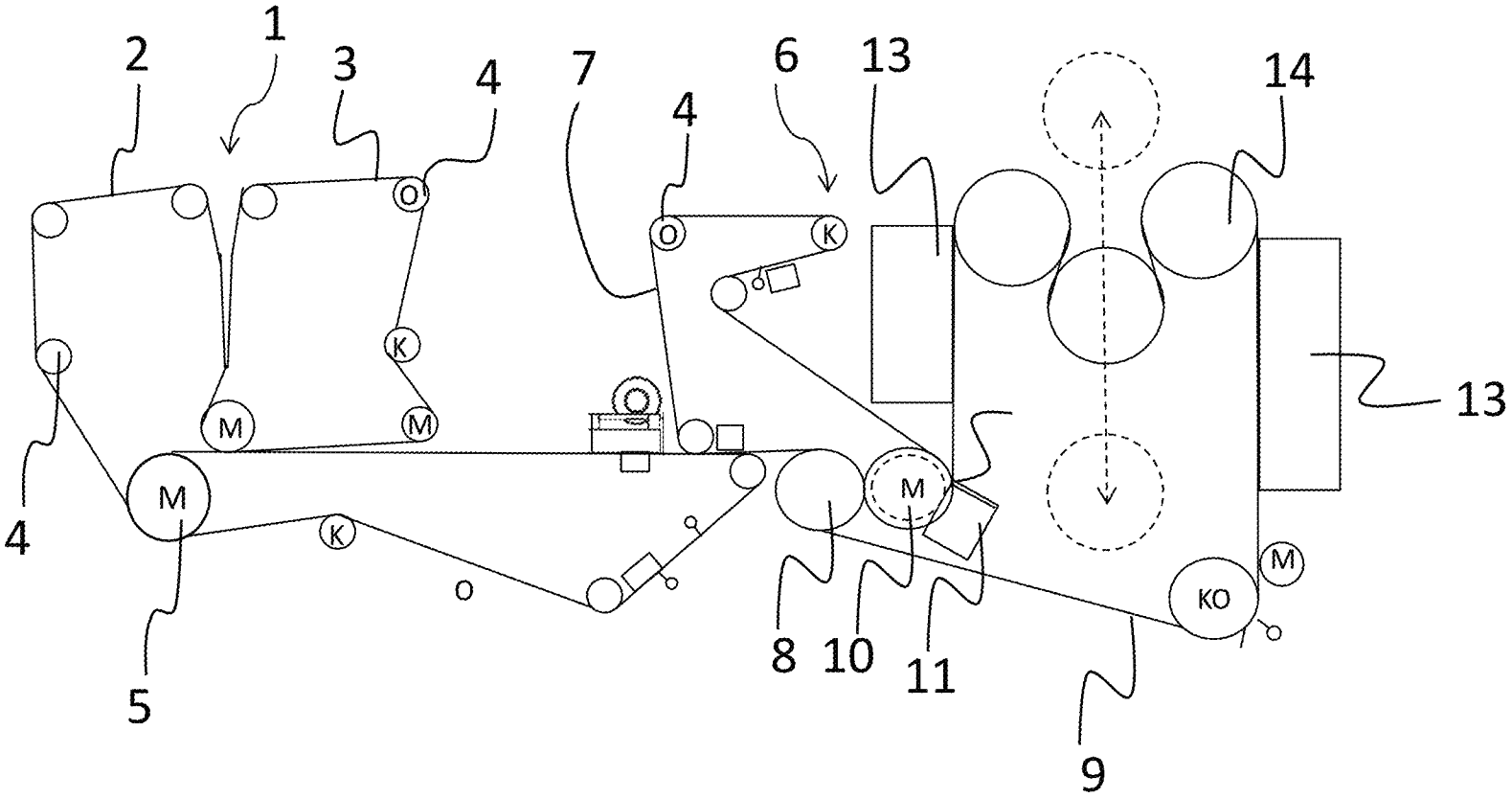
FIG. 1 illustrates schematically a web production process in accordance with at least some embodiments of the present invention.

FIG. 1 illustrates a production method and apparatus in accordance with at least some embodiments of the present invention. The formation step 1 is shown here as a general illustration of two fabrics 2, 3 that are set to run opposite to each other through guide 4 and driving 5 rolls. First of the fabrics 2 is arranged to run to a pressing felt 7 of a pressing and heating step 6. The web is taken on the first fabric 2 to the pressing felt 7 by means of vacuum. The pressing felt 7 is arranged to run so that it forms a nip with the first fabric 2. The web is transferred to the felt 7 on this nip. It is also possible to apply a combined long fabric i.e. felt or structured fabric as a long loop instead of fabrics 3 and 7 that transfers the web from forming to pressing and drying especially in tissue type of web applications. Next in the running direction of the felt 7 is a guide roll 8 of a metallic belt 9. The felt 7 and the metallic belt 9 form a nip and here the web is caught between the felt 7 and the belt 9. From the guide roll 8 the felt 7, belt 9 and the web that is placed there between are transferred downstream so that the web is following the metal belt on the metal belt 9 surface. The web is passed on the surface of the metal belt around heated rolls 14 so that at least one of heated rolls is on the web side and one on the back side of the metal belt. These rolls 14 may be heated with steam or other heating means such as induction but steam provides good heat transfer and adjustability. As steam heated rolls are readily available, they provide a recommendable alternative for controlled heating of the web. The web runs between the felt 7 and belt 9 around the grooved roll 10 and heated rolls 14. Here water is removed from the web in a controlled manner. The roll 10 is roll that is designed for removing liquid, usually water in paper, board or non-woven manufacture. The roll 10 is a called a grooved roll herein but may be a perforated roll or otherwise provided with passages for producing sufficient space for water removal so that the surface of the roll can receive the large amount of water that is removed from the web to the surface of the grooved roll 10 through the felt 7. The may heat during some manufacturing processes. Thus it may be provided with cooling system in order to keep lubrication conditions between the inner surface of the grooved roll 10 and the supporting surface inside the grooved roll sufficient in a continuous process where the temperature of the grooved roll may increase. The cooling of the grooved roll 10 may be provided by directing excess heat energy for heating warm waters needed in the process. This can be realized by a heat exchanger placed in the lubrication oil tank of the grooved roll.

The metal belt 9 is heated in this embodiment first by a pressurized steam chamber 11 positioned against the grooved roll 10 so that it covers the belt 9 on the opposite side of the belt 9 in view of the web and the felt 7. The steam chamber 11 is located so that it covers the belt 9 downstream from the exit point 12 of the belt 9 from the grooved roll 10. Upstream to the exit point 12 are arranged heaters 13 that are directed towards the belt 9 on the side that the web travels. In this embodiment there are two heaters 13. These may be any heaters or dryers used in the industry, for example steam dryers, impingement dryers, infrared dryers or induction heaters for heating the metal web. The metal belt should have some thermal energy (heat) when it returns to the guide roll 8 and contacts the web. In addition to these heaters 13, three heated rolls 14 are arranged between the heaters 13. The belt 9 and the web on the belt run around the heated rolls 14 and is further dried and smoothened in the process. The belt and the web may be arranged to run so that the web is against one or more of the heated rolls 14 during this drying step. In this way the web may be pressed against the roll for increasing the smoothness and dryness. The pressure and the surface of the roll can be adjusted and chosen so that desired level of smoothness and dryness is achieved and web shrinkage is prevented and also curling can be controlled.

The drying and smoothing pulse is achieved in the above described embodiment by using following arrangements and parameters:

1) The web is arranged to run between a felt 7 and a smooth hot metal belt 9
2) Felt 7 and metal belt 9 tension (pressure on the web), steam pressure and condensate pressure are adjusted to form a very long slowly increasing adjustable pressure and temperature profile, which heats the web and removes water and smoothens the web 3) Chamber 11 has adjustable seals and separate steam heating and pressurized condensate areas of increasing pressure and adjustable sealed excess water removal area to form the end of the pulse The above described smoothening and heating pulse enables higher production and quality as well as decreases production and investment costs. If the described embodiments of the pulse are combined with foam forming techniques described below, huge improvement step is possible. Available advantages are high dryness, bulk and smoothness of the web compared to presently used heating and drying methods.

Figure 2:
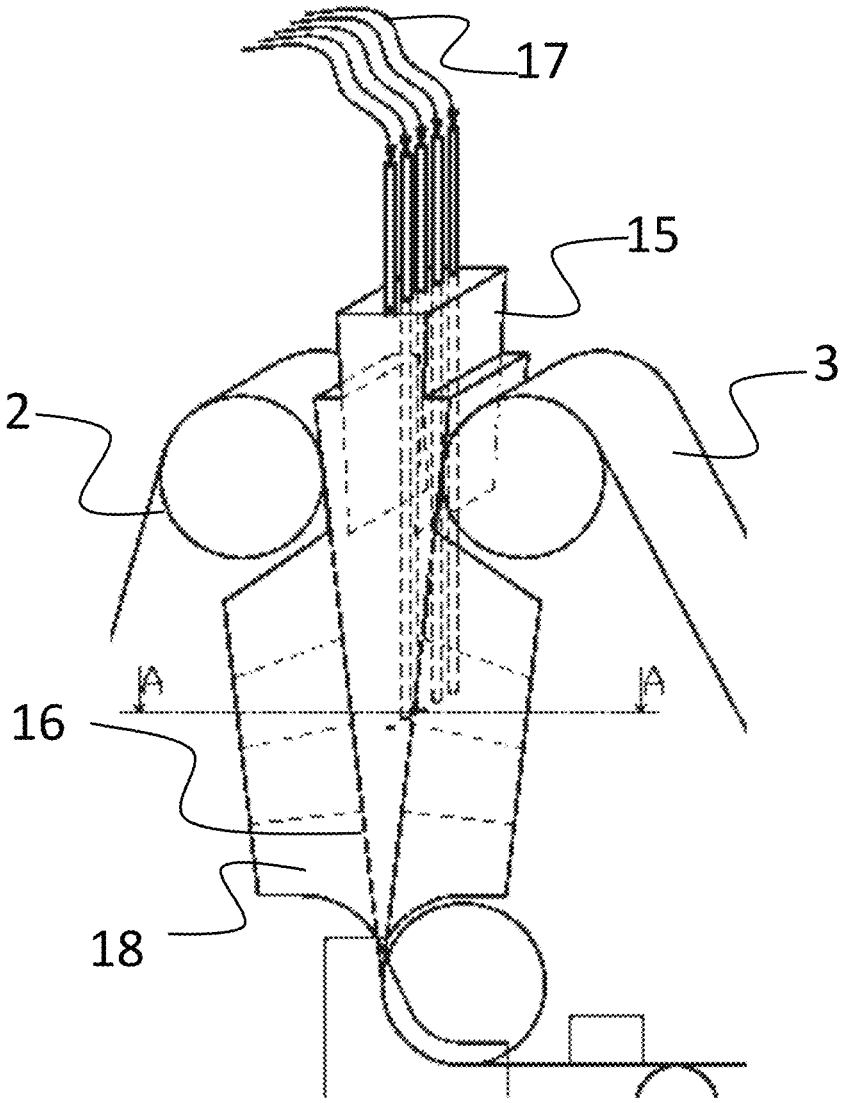
FIG. 2 illustrates one apparatus that can be utilized in at least some embodiments of the invention.

FIG. 2 illustrates one embodiment of a former apparatus for feeding furnish and forming the shape of a in the formation step. The former apparatus comprises two mobile permeable fabrics 2, 3 that are arranged to run in same direction so that the fabrics 2, 3 form a narrowing gap. In this gap is arranged an applicator 15 that has guide surfaces that face towards the fabrics and form a gap between the fabrics and the guide surfaces. In this embodiment the gap may be narrow and the fabrics may even run partially on the guide surfaces. This former apparatus is also designed for forming yarns and therefore the applicator has feeding tubes 17 for feeding narrow strips of furnish between the fabrics 2, 3 for forming the yarn strips. Vacuum boxes 18 are arranged on opposite sides of the fabrics 2, 3 in view of the feeding apparatus 15. These vacuum boxes 18 can be used for removing water from the yarn strips. The feeding tubes 17 may end either on the gap 16 between the guide surface and the fabric 2, 3 for water removal or on the nip between the fabrics 2, 3.

Figure 3:
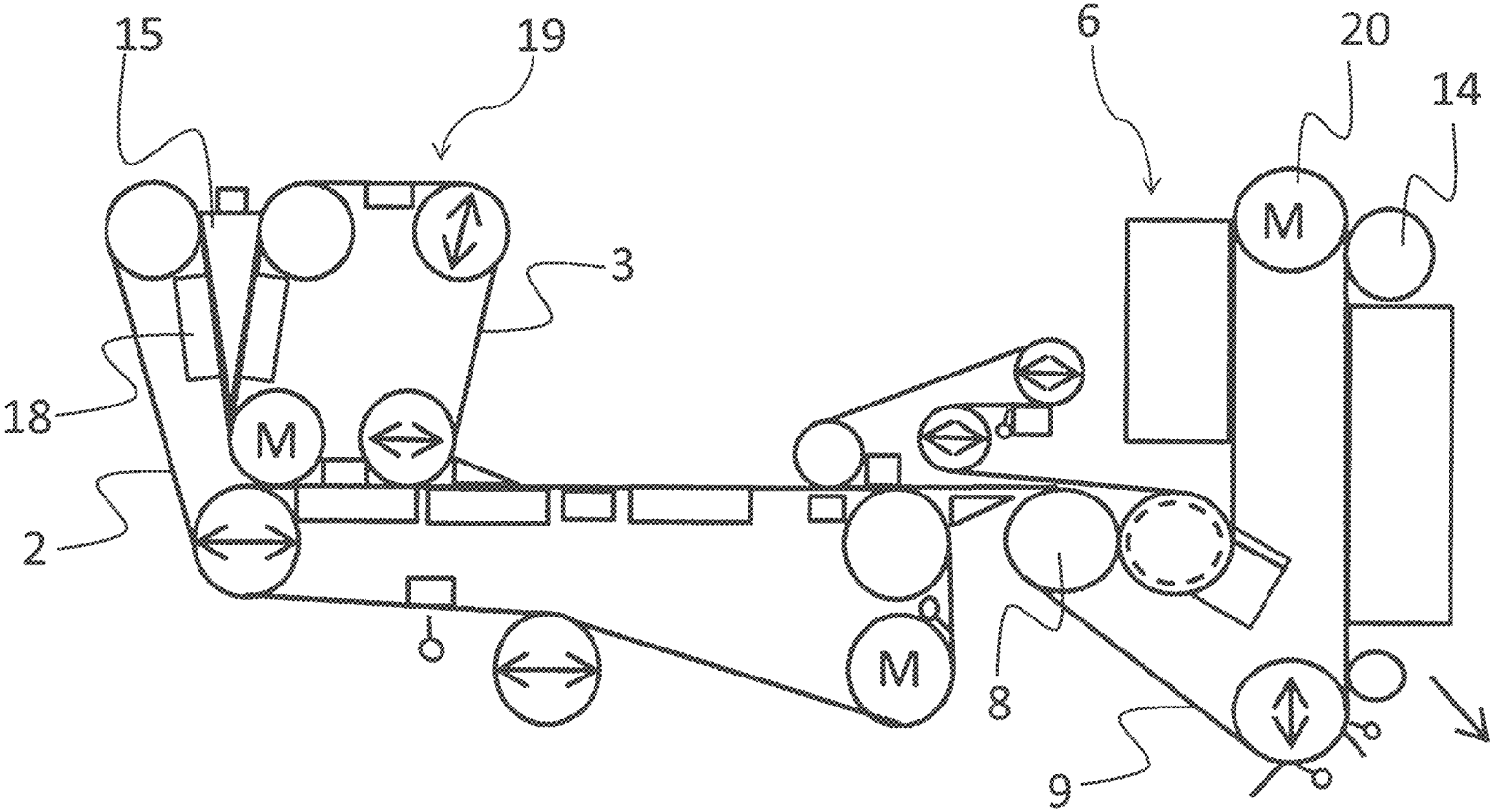
FIG. 3 illustrates an example apparatus capable of supporting at least some embodiments of the present invention.

FIG. 3 illustrates an embodiment wherein the above described former apparatus of a former apparatus described below may be utilized. The former apparatus 19 is arranged first in the upstream direction of the production process at the formation step 1 (FIG. 1). At this step furnish is fed to the nip of the fabrics 2, 3 in order to give form to the product that is manufactured. Some of the applicable forms are narrow strips for yarns, wider strips or webs for paper, board, fabric or non-woven products. After the formation step the product is transferred to the pressing and heating stage 6. In this stage pressing and heating is performed as described above. Only difference is that instead of set of heated rolls 14 only one heated roll 14 is used. This heated roll 14 is arranged to form a nip with a drive roll 20 of the belt 9 providing a smoothing nip.

Figure 4:
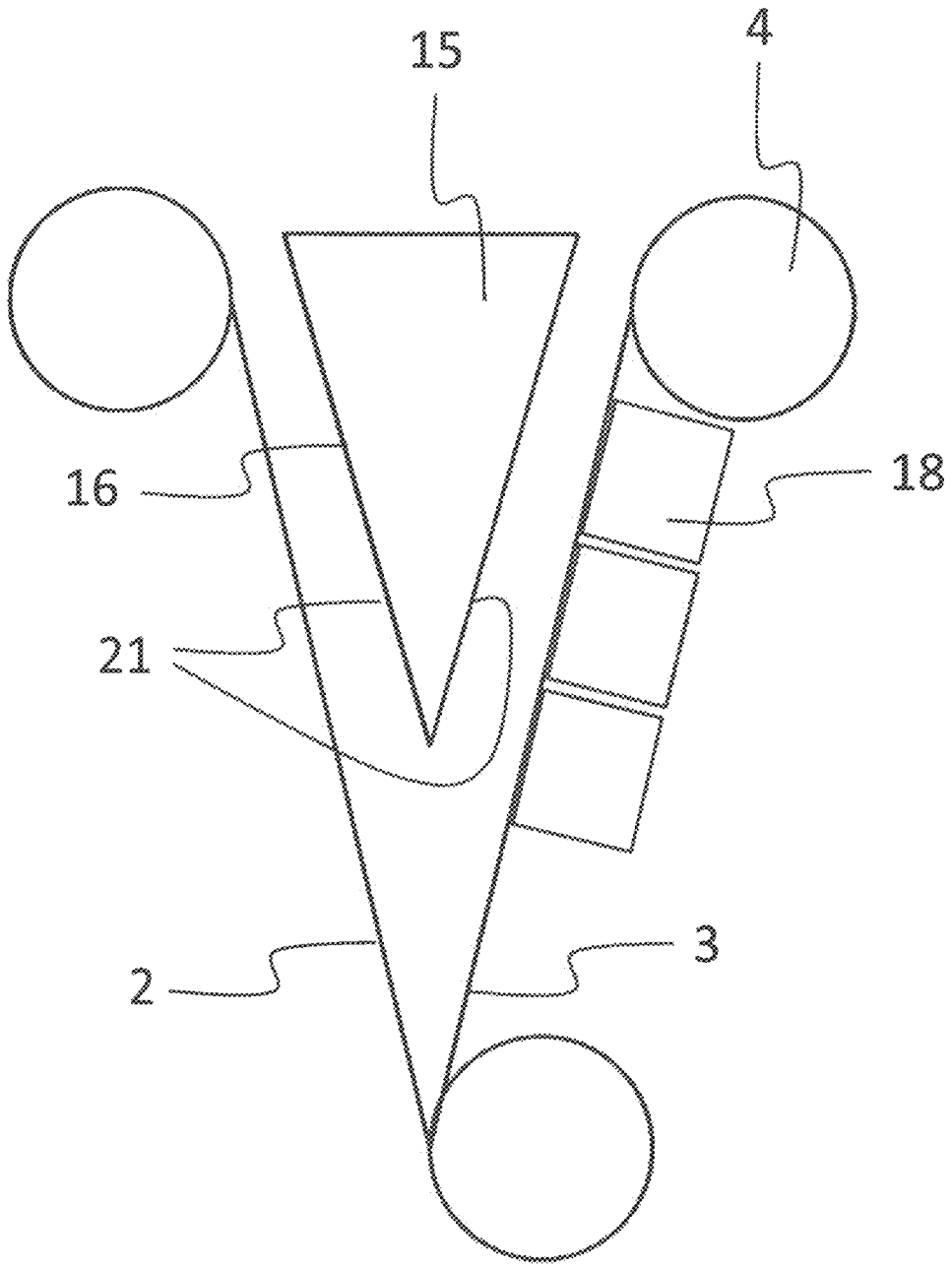
FIG. 4 illustrates an alternative to the apparatus in FIG. 2.
Figure 5:
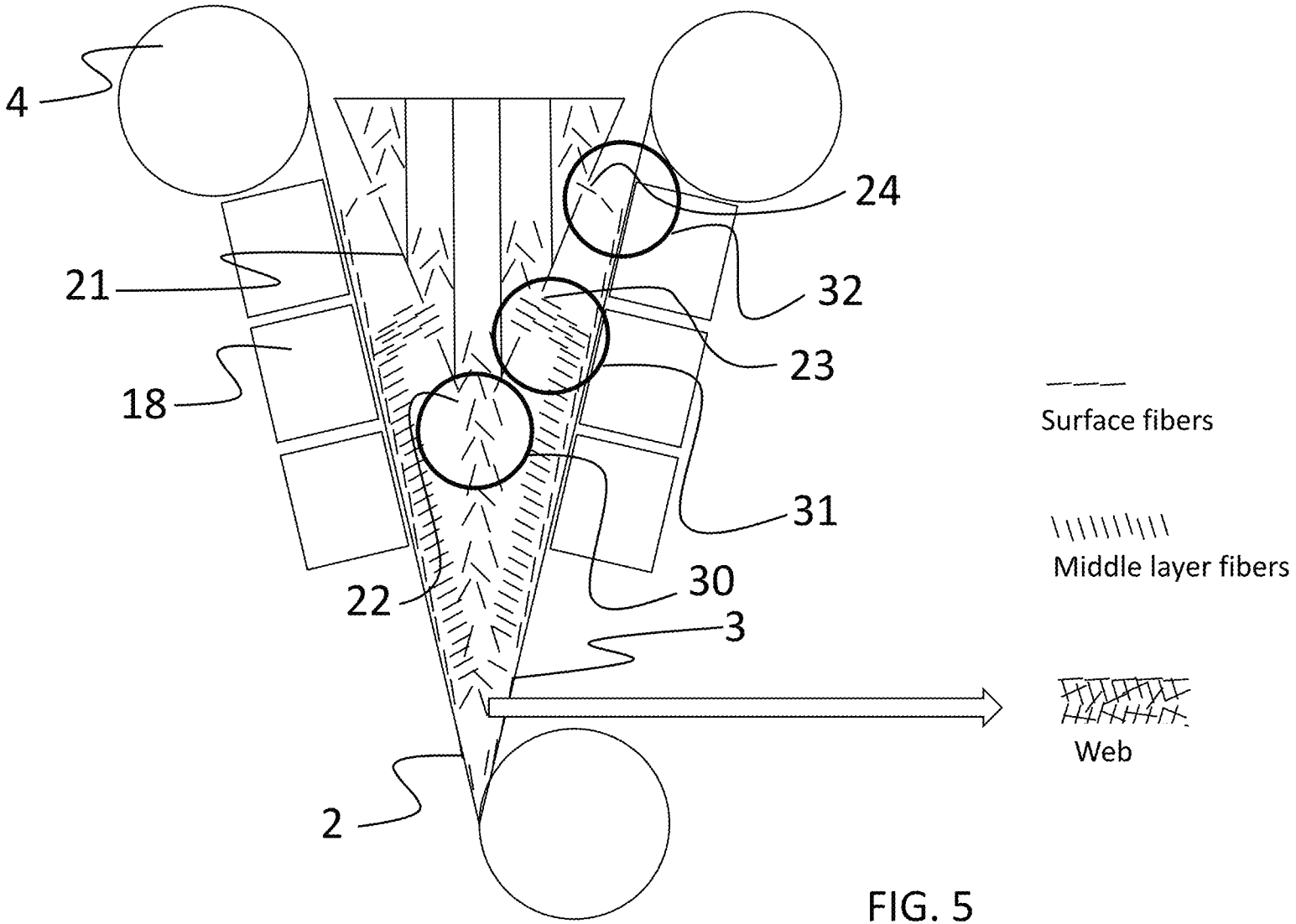
FIG. 5 illustrates the apparatus of FIG. 4 in more detail.

FIGS. 4 and 5 describe one embodiment of the former apparatus 19. This former apparatus is capable of producing layered products that have controlled fibre orientation in different layers. This apparatus also comprises two permeable fabrics 2, 3 that are set to form a narrowing gap for receiving and pressing of the furnish fed into the gap. The feeding apparatus 15 comprises feeding slot arrangement described in more detail below. The guide surfaces 21 of the feeding apparatus 15 are adjustable in order to obtain adjustable distance from a feeding slot to the fabric. The flow velocity in the narrowing nip can be adjusted by changing the angel of the guide surfaces in relation to the fabrics 2, 3. If the gap 16 widens, the flow velocity decreases on same feeding rate and oppositely, if the gap 16 narrows, the velocity increases. The fabrics 2, 3 are arranged to run around guide rolls 4 and vacuum boxes are positioned against the fabrics 2, 3 on the opposite side of the fabric in view of the feeding apparatus.

The feeding apparatus has adjustable feeding slots to create the correct flow conditions in different web layers. Layers contain fibers, fillers, chemicals, particles, yarns etc. needed for different types of webs. The guide surfaces are adjustable to provide adjustable distance from slot to fabric. Distance can be shorter in the upper part of the feeding apparatus where MD (machine direction) flow downwards is wished near the moving fabric surface→the fibres forming the web surface turn then to MD. Bigger distance in the lower part on the feeding apparatus is used to minimize MD flow rate. As a result fibres stay in ZD (z-direction, the thickness dimension of the web). Adjustable vacuum boxes are used to control the flow of the furnish, less vacuum slots in the beginning of the adjustable gap 16 between the fabric and the guide surface to ensure that surface fibres of the web turn to MD. Pressure difference obtained by the vacuum boxes also removes fluids from the flowing medium: when solid content and viscosity increases internal stability of the furnish increases resulting to more laminar flow whereby the fibers stay in wished direction. Tip slot(s) of the feeding apparatus may be used to adjust fibers in wished direction or to produce random fibre orientation to maximise middle layer strength. These parameters may be used to accomplish a mainly pseudoplastic liquid behaviour in the furnish. This provides a shear thinning non-turbulent and non-flocking flow instead of newton type behaviour of know apparatuses (always flowable, turbulent, flocking)

FIGS. 4 and 5 illustrate an example apparatus capable of supporting at least some embodiments of the present invention. FIG. 5 shows the slot arrangement of the feeding apparatus on more detail. At the tip of the feeding apparatus on the point where guide surfaces 21 end, is a narrow tip slot 22 that extends over the width of the fabrics. Alternatively, the longitudinal slot may be substituted by several shorter slots or nozzles. The tip slot 22 is preferably adjustable in order to provide adjustable flow. This can provide a flow wherein the fibres are randomly orientated (see ring 30, FIG. 5). This provides higher strength between the fibres. Upstream to the tip slot 22 on both sides of the feeding apparatus are second feeding slots 23. These are also preferably adjustable and together with adjustability of the guide surface 21 provide means for obtaining a flow that has increased higher velocity and viscosity in a laminar flow (see ring 31, FIG. 5). In this way the fibres in the middle layer of the web can be maintained in z-direction (thickness direction), which provides high strength in z-direction and high bulk. The second feeding slots 23 may be one narrow slot extending over the width of a fabric or several narrow nozzles or slots may be used. Upstream from second slots 23 on the guide surface 21 are third slots 24. These are closest to the fabrics 2, 3 and designed to provide flow with low fibre velocity and viscosity. Small auxiliary flow may be fed on the fabric in machine direction before the third slots 24. The velocity of the tertiary flow from the third slot is preferably same or slower than the speed of the fabric. In this way the moving fabric and MD flow turn the fibres hitting the fabric to MD (see ring 32, FIG. 5). This provides high MD strength and smooth web surface.

The features of above described embodiments in method and apparatus for feeding the furnish may be further emphasized by using foamed furnish. Foaming aids control of viscosity and fibre orientation. The form of the feeding slots and narrowing gaps provide excellent possibilities to control the flow and transfer of the flow behaviour from plastic to pseudoplastic flow. Thus the fibre orientation is more rapid when foam based furnish is used in comparison to water based furnishes.

At least some embodiments of the invention provide adjustable fibre orientation control, fibre feed area is low- or non-pressurized for good fibre control, controlled layered structures, long fibres can be applied up to carding application, adjustable water removal through the wire section, and new adjustable efficient web heating, pressing, drying and smoothing. Further, at least some embodiments provide efficient fibre orientation control and initial water removal, efficient metal belt water removal, drying, smoothing and creping, possibility to form different products applying foam, low energy and raw material consumption, high dryness, bulk, smoothness and drying capacity. Foam forming and at least some embodiments of the invention provide use of foam layering headbox, low- or non-pressurised initial forming, low-pressurised water removal, MD/CD/ZD fibre orientation control, foam sizing and coating, long heating and pressing zone, long drying and smoothing zone.

The invention provides by at least some of its embodiments further benefits. Fibres in different fibre layers (including long fibres) can be arranged in wished directions to produce webs that have good properties and low manufacturing costs. High solids in fibre suspensions can be applied without flocs, this increases achieved web formation solids and reduces amount of water and energy needed. The method according to invention keeps the oriented fibre construction. New fibre layers can be arranged on top/under the previous layer without weakening the structure of the previous layer. Mixing fibre layers can be arranged when strength properties in certain direction are needed. High bulk can be achieved. High surface smoothness can be achieved. Possible to minimise web production costs, new web structure enables use of less and lower cost raw materials to produce high quality webs. Possible to apply any type of fibres, fillers, chemical, additives, yarns.

Main technological feature of at least some embodiments of the invention are: novel method to arrange fibres in wished direction, novel apparatus based on the method and novel web structure containing oriented fiber layers. Main application area is new type of webs.

In the following, features of the embodiments of the invention are summarized and further clarified. It must be noted that the invention provides several possibilities to implement its various embodiments and all of the features described below are possibly not realizable in all of the embodiments.

One feature characterizing most embodiments relating to water removal and drying is achieving predescribed temperatures and pressures on the pressing section for a long enough time. Some benefits obtained by embodiments of the invention are higher bulk, thickness, higher DMC (dry matter content) during manufacture and improved smoothness. Some of these benefits are presented in FIG. 10. Further test have shown that for a predetermined smoothness level the increase in bulk may be even higher in comparison to known method used in the test. The reason for this is that some embodiments of the invention allow production of a web having high bulk and smoothness using a single pressing step. Known methods require 2-4 pressing nips and calandering in 1-3 calandering nips in order to achieve same levels of smoothness achievable with some embodiments of the invention. Several pressing stages and calandering lead to loss of bulk as is well known in the art. Using z-former described above for forming the web using foam forming technology further improves the benefits obtained by a controlled pressing stage.

Both of the above described forming method and apparatus as well as the pressing method and apparatus aim to higher dry matter contents than previously used in the art. The embodiments of the former described above provide increase of DMC from about 0.1-3% (infeed consistency) to a level of 20-30% after forming. Known art achieves only levels of 18-25% after the wire section. New pressing technology provides DMC levels of 40-65% after pressing compared to characteristic level of 30-55% of the known art.

In order to achieve high bulk it is beneficial to use very low pressure in the pressing nip. Maximum pressure of 0.1-1 MPa can be used in the pressing nip combined to a long heated pressure pulse. Using low pressure makes it easier to accomplish the machinery of the pressing stage as lighter structures can be used and lower pressures are easier to seal. The embodiments of the invention may replace a large, expensive multi-level wire section, multi-nip felt pressing section and a long drying section comprising several drying cylinders as well as a multi-nip calander. The embodiments of the invention provide a more simple, shorter and more efficient machinery comprising less felts and components needing maintenance.

The temperature of the web may rise above 80° C. for thin products and already during first 10-30 ms of a thin web in the contact between metal belt and a felt. On the other hand for very thick products like heavy cardboard it may happen that the felt side of the web doesn't achieve the temperature of 80° C. in the pressing nip. Typically the pressing pulse is 10-200 ms 0.01±0.01 MPa+10-200 ms 0.1±0.1 MPa+10-200 ms 0.1-1 MPa+10-100 ms 0.1-10 MPa. The side of the web that is against the metal belt achieves a temperature of about 80-110° C. and the felt side about 50-90° C. at the pressing nip. In practice some cooler water is first removed from the web to the felt and thereafter heated water, that especially for thin webs (tissue, paper, board) heat the felt significantly. The temperature of the felt may increase to a level of 50-80° C. As the temperature of the web is typically about 30-60° C. when it arrives to the nip from the wire section, the web heats in practise on both sides immediately when it arrives to the first contact between the felt and the metal belt.

In summary, the combination of various embodiments of the invention provides a production method including following steps: 1) Feeding fibers and additives, orientation of the fibres and forming fibre layers by z-former, 2) removing water at narrowing gap of the z-former and thereafter by pressurizing and suction, 3) moving the web by suction using decreased pressure of 5-70 kPa from the wire fabric to a pressing felt 4) heating the web and transferring water to the felt, the web is transferred to the pressing section, 5) initial pressing 1: achieved by tension of the felt against the metal belt and a roll, 6) initial pressing 2: tension of the metal belt against the felt and the roll, 7) increasing the temperature of the metal belt and actual pressing 1: tension of the metal belt and steam pressure against felt and the roll, 8) actual pressing 2: tension of the metal belt and pressurized water against felt and the roll, 9) drying of the web on the metal belt, preferably impingement dryers for increasing the evaporation on the side of the web opposite to the belt, 10) further heating of the metal belt by a steam cylinder, 11) heating and smoothing of the web by a steam cylinder, 12) repeating phases 9-11 for achieving desired level of bulk, DMC, smoothness etc, 13) removing the web from the metal belt of crepping for tissue, 14) further processing, for example sizing, coating, further calandering patterning, embossing, slitting etc.

EXPERIMENTAL RESULTS

Example 1

Furnish and Sample Preparation:

200 g/m2 Board: 90% preground pine, 10% coloured CTMP

Sample preparation:

Mould water samples

Mould foam samples

Modified foam mould z-oriented foam samples

Z-Orientation Foam Procedure (z-Forming):

1) Furnish consistency is optimized before foaming (2.7% was optimal for this furnish, if higher→low formation, if lower→low orientation, fibers turn back to horizontal)

2) Foam is poured onto wire applying a pouring device that orients fibers (fibers turn to z-direction when they go over the edge and fall on wire vertically, some of the fibers (bottom layer) turn back to horizontal when they hit the wire, but some (top layer) stay in z-direction)

3) Sample is densified applying an impermeable film and vacuum

Figure 6:
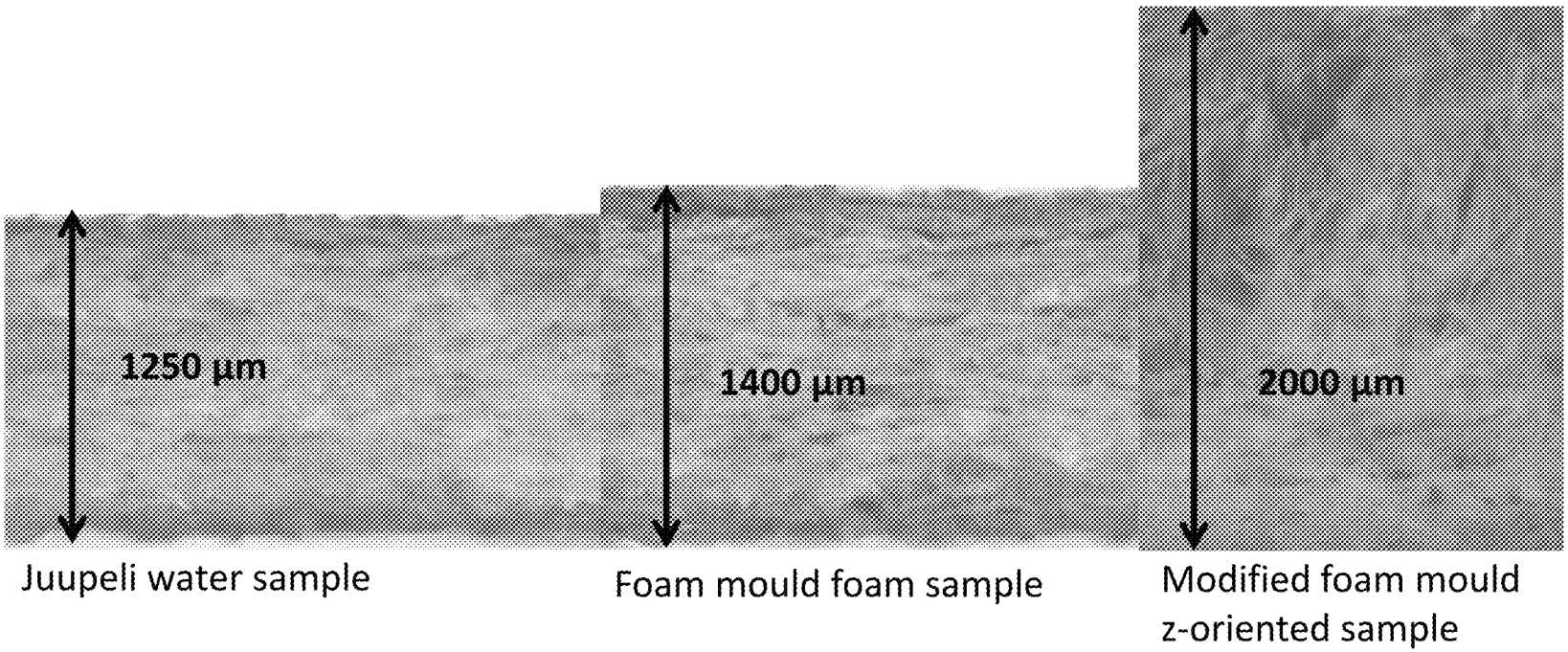
FIG. 6 illustrates samples of products made by using known methods and an embodiment of the invention.

The test show that z-orientated modified foam samples have superior bulk compared to other test samples, see FIG. 6. All samples here have the same basis weight, 200 g/m2.

Figure 7:
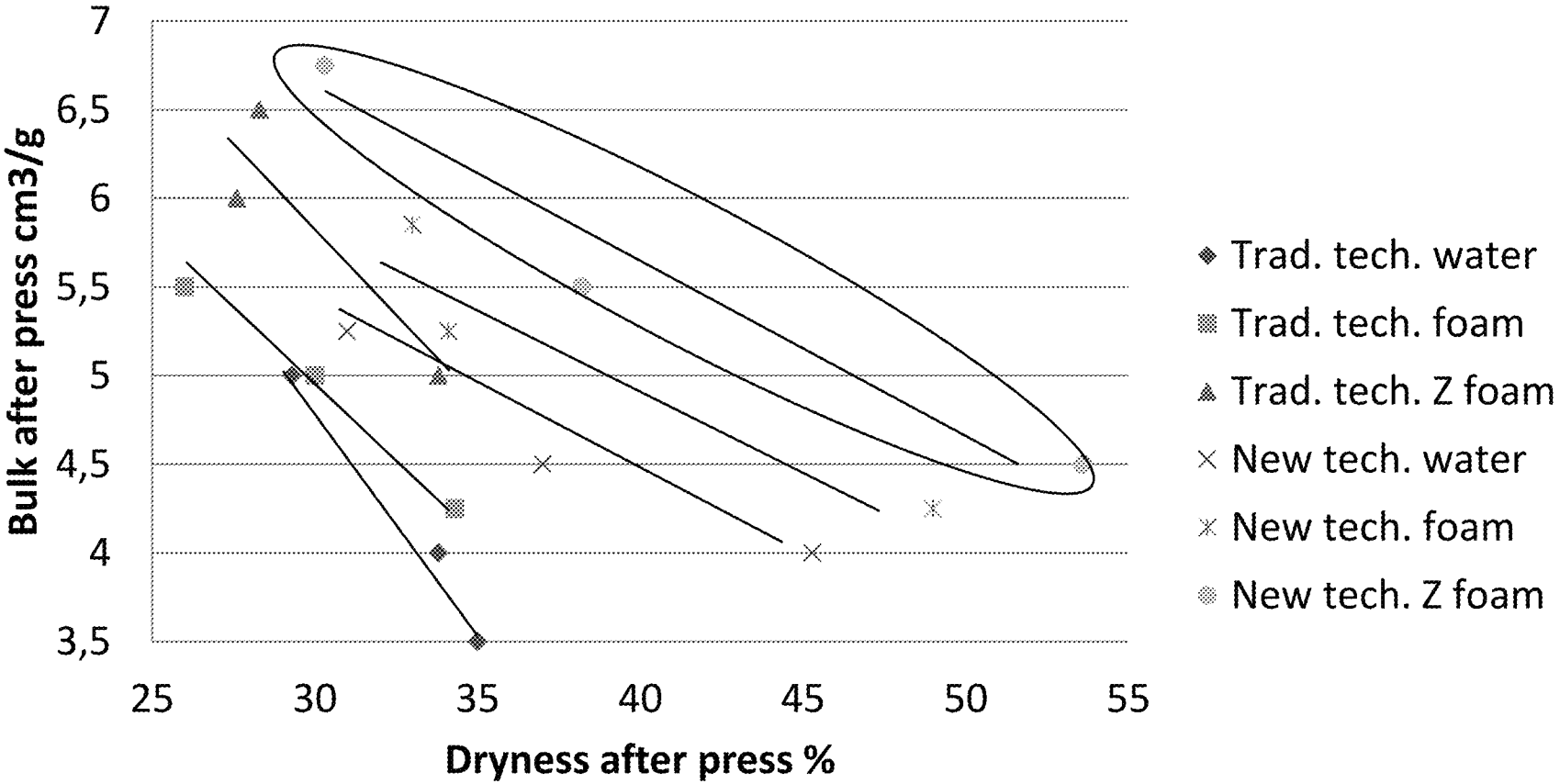
Figure 8:
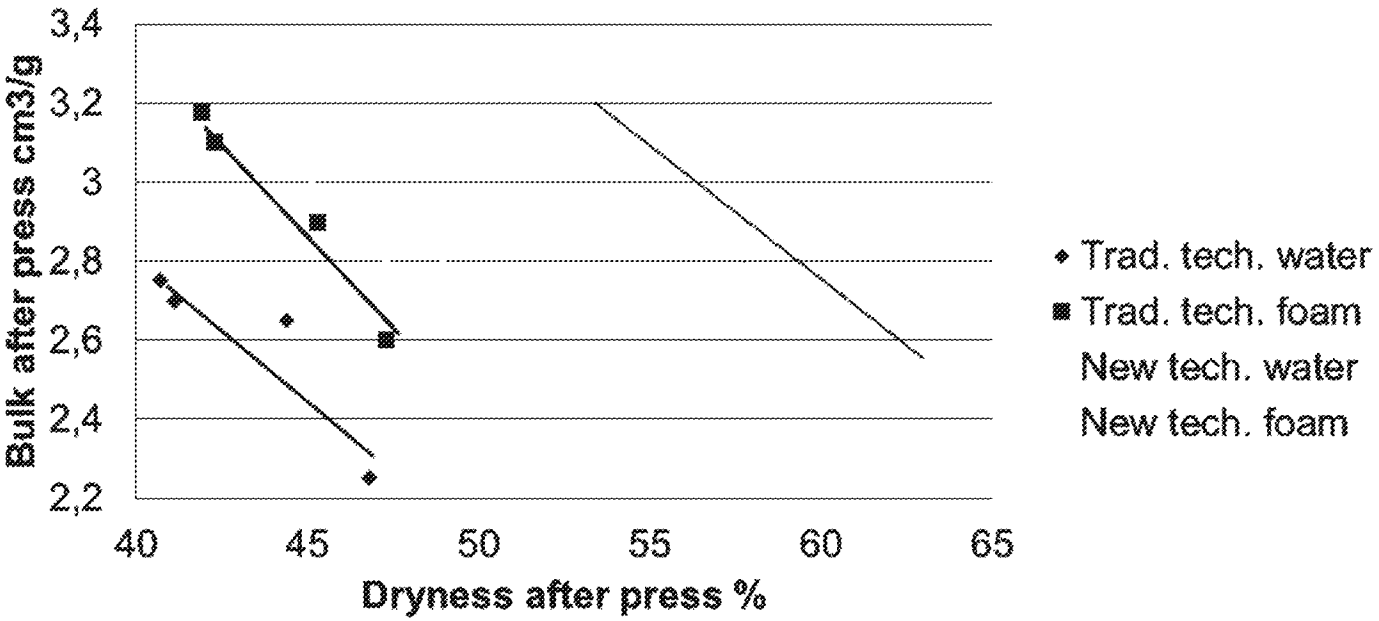
Figure 9:
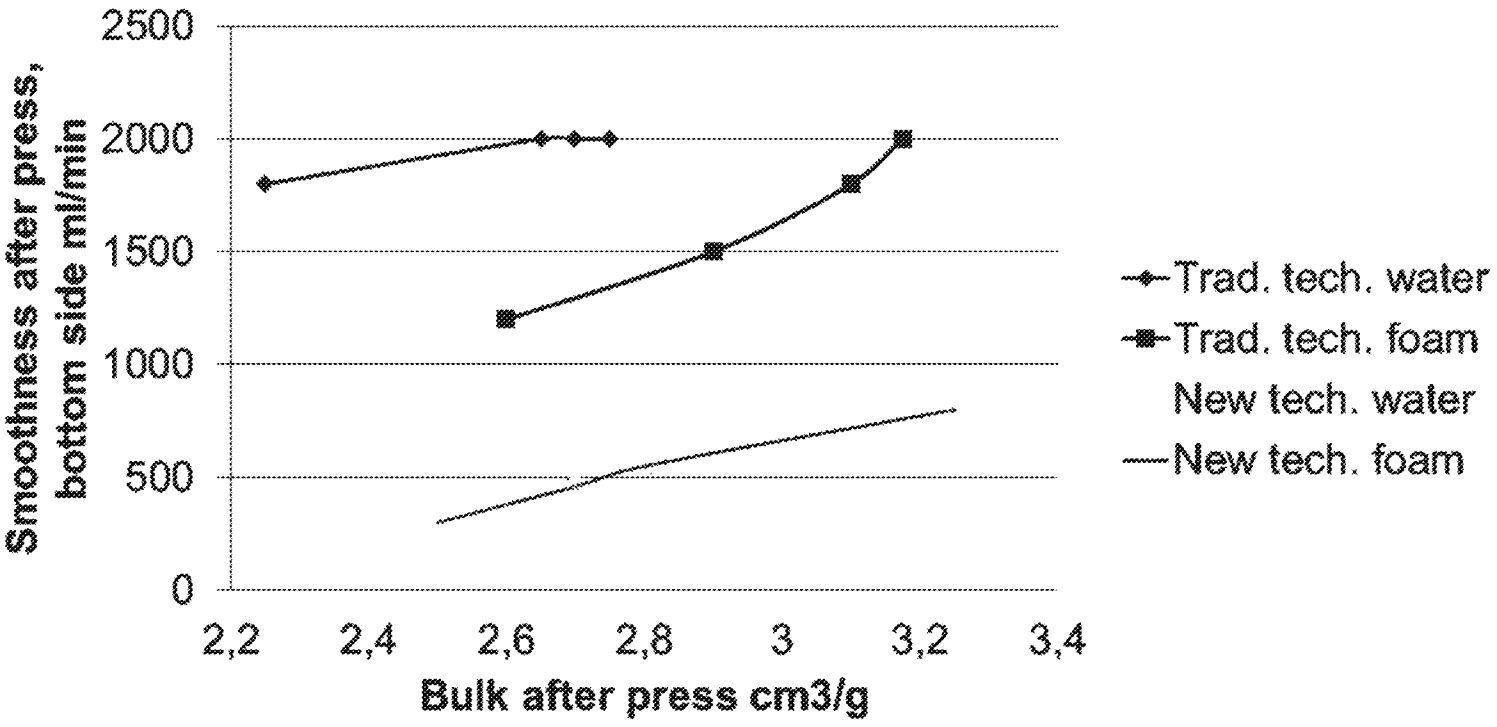

FIG. 7 shows test results obtained when board were produced by one embodiment of the invention (new tech) and comparable prior art manufacturing methods (trad. tech). Samples were made using water furnish, foam furnish and z-foam formation technique. Results show that all samples made according to an embodiment of the invention had higher bulk and dryness in view of a sample made with a comparable traditional technology. Best results were obtained when the z-forming technique according to an embodiment of the invention were combined with an embodiment of invention FIGS. 8 and 9 show that higher bulk and improved Bendtsen smoothness can be achieved for web produced according to an embodiment of the invention.

FIG. 10 shows changes in web properties of webs made according to the embodiments of the invention in relation to webs made using known methods. The FIG. 10 shows that each stage, foam forming, metal belt pressing and drying and combination thereof provides notable improvements in dryness after press, bulk after press and smoothness after press. The features benefit for increased production, lower investment and production costs, savings in raw materials and improves properties.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in board, paper, tissue and non-woven industry.

ACRONYMS LIST

DMC is dry matter content

The invention claimed is:

1. An apparatus for forming a fiber web comprising:

a forming section for feeding an aqueous fiber furnish on a moving surface to form a fiber web; and a pressing and heating section for removing water from the formed web received from the moving surface; wherein the pressing and heating section comprises a felt and a smooth metal belt that are set to run against each other for receiving the formed web from the moving surface, heating elements for heating the web in at least two pulses including at least one first pulse wherein the web is heated and pressed for at least 10-200 ms on a first pressure and at least one second heating and smoothing pulse wherein the web is heated at least for 10-200 ms on a pressure that is higher than the first pressure, wherein at least one of the surfaces pressing the web is the smooth metal belt, a forming apparatus having a narrowing nip formed of two moving permeable fabrics and a feeding apparatus comprising at least one guide surface that forms a gap together with at least one of the moving permeable fabrics, and at least one feeding opening for feeding furnish to the narrowing nip, and a first feeding slot for feeding the furnish on the nip of the moving permeable fabrics as one central first flow to form a central layer of the web, second feeding slots for feeding the furnish as two secondary flows perpendicular to the moving permeable fabrics on both sides of the central flow to form second layers of the web, and third feeding slots for feeding two tertiary flows having speed lower than the moving permeable fabrics and being fed on both sides of the central flow, the feeding points of the second slots being upstream of the first slot and feeding points of the third slots being upstream to the second slots.

2. The apparatus according to the claim 1, further comprising at least one vacuum box at the side of at least one of the fabrics that is opposite to the side facing the narrowing nip and the feeding apparatus.

3. The apparatus according to claim 1, wherein the heating elements are arranged to heat the web to a temperature reaching at least 80° C. on at least one surface of the web at the end of the last pulse.

4. The apparatus according to claim 1, comprising heating and pressing elements for heating the web in pulses comprising a first pulse of 10-200 ms at 0.01±0.01 MPa, a second pulse of 10-200 ms at 0.1±0.1 MPa, a third pulse of 10-200 ms at 0.1-1 MPa, and a fourth pulse of 10-100 ms at 0.1-10 MPa.

5. The apparatus according to claim 1, wherein the heating elements for heating the web and the smooth metal belt comprise at least one of the following: a heated roll against the web and/or smooth metal belt, a heater on the back side of the smooth metal belt, a heater on the web side of the smooth metal belt.

6. The apparatus according to claim 1, wherein the felt and smooth metal belt are arranged to be pressed against each other in order to provide the first pulse.

7. The apparatus according to claim 1, wherein the web is arranged to run around at least one heated roll supported by the smooth metal belt for providing a second pulse.

8. The apparatus according to claim 1, wherein the web is arranged to run around more than one heated roll supported by the smooth metal belt for providing a second pulse or pulses.

9. A method for producing fiber webs, comprising a forming step for feeding an aqueous furnish of fibers on a moving surface to form a shape of a web; and a pressing and heating step for removing water from the shaped web received from the moving surface; wherein at the pressing and heating step the shaped web is received between a felt and smooth metal belt that are set to run against each other; and the web is heated by heating elements between the felt and the smooth metal belt in at least two pulses including at least one heating pulse wherein the web is pressed for at least 10-200 ms on a first pressure and at least one heating and smoothing pulse wherein the web is heated at least for 10-200 ms on a pressure that is higher than the first pressure, and at least one of the surfaces pressing the web being the smooth metal belt, wherein a narrowing nip is formed of two moving permeable fabrics and furnish of at least water and fibers is fed into the nip of the fabrics by a feeding apparatus comprising at least one guide surface that forms a gap together with at least one of the fabrics, and the furnish is fed on the nip of the fabrics as one central first flow to form a central layer of the web-like web, as two secondary flows perpendicular to the moving permeable fabrics on both sides of the central flow to form second layers or the web and as two tertiary flows having speed lower than the fabrics and being fed on both sides of the central flow, the feeding points of the second flows being upstream of the first flow and feeding points of the third flows being upstream to the second flows.

10. The method according to claim 9, wherein the temperature of the web entering to the pressing and drying step is gradually increased from incoming temperature of 30-60° C. to a drying temperature of 80-100° C.

11. The method according to claim 9, wherein the furnish is fed on the nip of the moving permeable fabrics as a mixture of foam and fibers.

12. The method according to claim 9, wherein water is removed from furnish by suction through the moving permeable fabrics.

13. The method according to claim 9, wherein the felt and the smooth metal belt are arranged to be pressed against each other in order to provide the first pulse.

14. The method according to claim 9, wherein the web is arranged to run around at least one heated roll supported by the smooth metal belt for providing a second pulse.

15. The method according to claim 9, wherein the web is arranged to run around at more than one heated roll supported by the smooth metal belt for providing a second pulse or pulses.

16. The method according to claim 9, wherein the web is heated by the heating elements to a temperature reaching at least 80° C. on at least one surface of the web at the end of the last pulse.

17. The method according to claim 9, further comprising heating and pressing the web in pulses comprising a first pulse of 10-200 ms 0.01±0.01 MPa, a second pulse of 10-200 ms 0.1±0.1 MPa, a third pulse of 10-200 ms 0.1-1 MPa, and a fourth pulse of 10-100 ms 0.1-10 MPa.

18. The method according to claim 9, wherein the side of the web that is against the smooth metal belt is heated to a temperature of about 80-110° C. and the felt side about 50-90° C. at the narrowing nip.

19. The method according to claim 9, wherein the infeed DMC of the furnish is 0.1-3%, the DMC of the web is 20-30% after forming and 40-65% after the pressing and heating step.

* * * * *